US006122477A

United States Patent [19]

Parker

[11] Patent Number: 6,122,477

[45] Date of Patent: Sep. 19, 2000

[54] INDUCTION HEATED FUSING APPARATUS HAVING A DUAL FUNCTION TRANSFORMER ASSEMBLY

[75] Inventor: Delmer G. Parker, Rochester, N.Y.

[73] Assignee: Xerox Corporation, Stamford, Conn.

[21] Appl. No.: 09/307,842

[22] Filed: May 10, 1999

[51] Int. Cl.[7] ..... G03G 15/20

[52] U.S. Cl. ..... 399/330

[58] Field of Search ..... 399/69, 329, 330, 399/331

[56] References Cited

U.S. PATENT DOCUMENTS

| | | | |
|---|---|---|---|
| 4,570,044 | 2/1986 | Kobayashi et al. | 219/10.49 A |
| 5,745,833 | 4/1998 | Abe et al. | 399/330 |
| 5,783,806 | 7/1998 | Hayasaki | 399/330 X |
| 5,801,359 | 9/1998 | Mano et al. | 399/329 |
| 5,862,445 | 1/1999 | Ogawa et al. | 399/329 |
| 5,911,094 | 6/1999 | Tsujimoto | 399/69 |

*Primary Examiner*—Fred L. Braun
*Attorney, Agent, or Firm*—Tallam I. Nguti

[57] ABSTRACT

An induction heated fusing apparatus having a dual function transformer assembly includes a pressure roller, an induction heatable fuser roller, an electrical circuit subassembly coupled to a primary transformer coil and connectable to an AC power supply source. The electrical circuit assembly includes a bridge circuit and a pair of transistors having their emitters connected to an output of a bridge circuit, their bases connected to opposite ends of an auxiliary conductive coil winding, and their collectors connected to opposite ends of a primary transformer coil, wherein the pair of transistors and the primary transformer coil are alternately driven by voltage changes across the auxiliary conductive coil winding.

4 Claims, 2 Drawing Sheets

INDUCTION HEATED FUSING APPARATUS HAVING A DUAL FUNCTION TRANSFORMER ASSEMBLY

RELATED APPLICATIONS

This application is related to U.S. application Ser. No. 09/307,445 (Applicant's Docket No. D/96612) entitled "FUSING APPARATUS HAVING AN INDUCTION HEATED FUSER ROLLER" filed on even date herewith, and having at least one common inventor.

BACKGROUND OF THE INVENTION

This invention relates to fusing toner images and more particularly to a heat and pressure roller fuser for fixing toner images to copy substrates.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

After the electrostatic latent image is recorded on the photoconductive surface, it is developed by bringing a developer material including toner particles into contact therewith to thereby form toner images on the photoconductive surface. The images are generally transferred to a support surface such as plain paper to which they may be permanently affixed by heating or by the application of pressure or a combination of both.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roller to thereby effect heating of the toner images within the nip. As will be appreciated, in a machine where duplex images are created both rolls may be heated. In either case, one of the rolls is usually referred to as the fuser roller while the other is commonly referred to as a pressure or back-up roll.

As Xerographic or electrostatographic machines become smaller and smaller, there is a need to make fusing apparatus with smaller and smaller fuser rollers, as well as a need to make such a fusing apparatus economical and efficient.

SUMMARY OF THE INVENTION

In accordance with the present invention, there is provided an induction heated fusing apparatus having a dual function transformer assembly. The fusing apparatus includes a pressure roller and an induction heatable fuser roller having an electrically conductive sheath near the surface and forming a fusing nip with the pressure roller. The fusing apparatus also includes a dual function transformer assembly for inductively heating the induction heatable fuser roller as a first function, and for increasing a supply frequency F1 of an AC power supply source to a desired inductive heating frequency F2 for the induction heatable fuser roller, as a second function. The dual function transformer assembly includes a closed loop magnetic flux carrying member comprising a transformer core having a first side surrounded with the induction heatable fuser roller as a secondary transformer coil, and a second side having a primary transformer coil winding over it. The dual function transformer assembly also includes an electrical circuit subassembly coupled to the primary transformer coil and connectable to the AC power supply source having the supply frequency F1, whereby the supply frequency F1 is increased to the desired inductive heating frequency F2, and the heatable fuser roller is inductively heated by the transformer assembly, when the electrical circuit subassembly is connected to the AC power supply source.

BRIEF DESCRIPTION OF THE DRAWINGS

In the detailed description of the invention presented below, reference is made to the drawings, in which.

DETAILED DESCRIPTION OF THE PRESENT INVENTION

Figure 1:
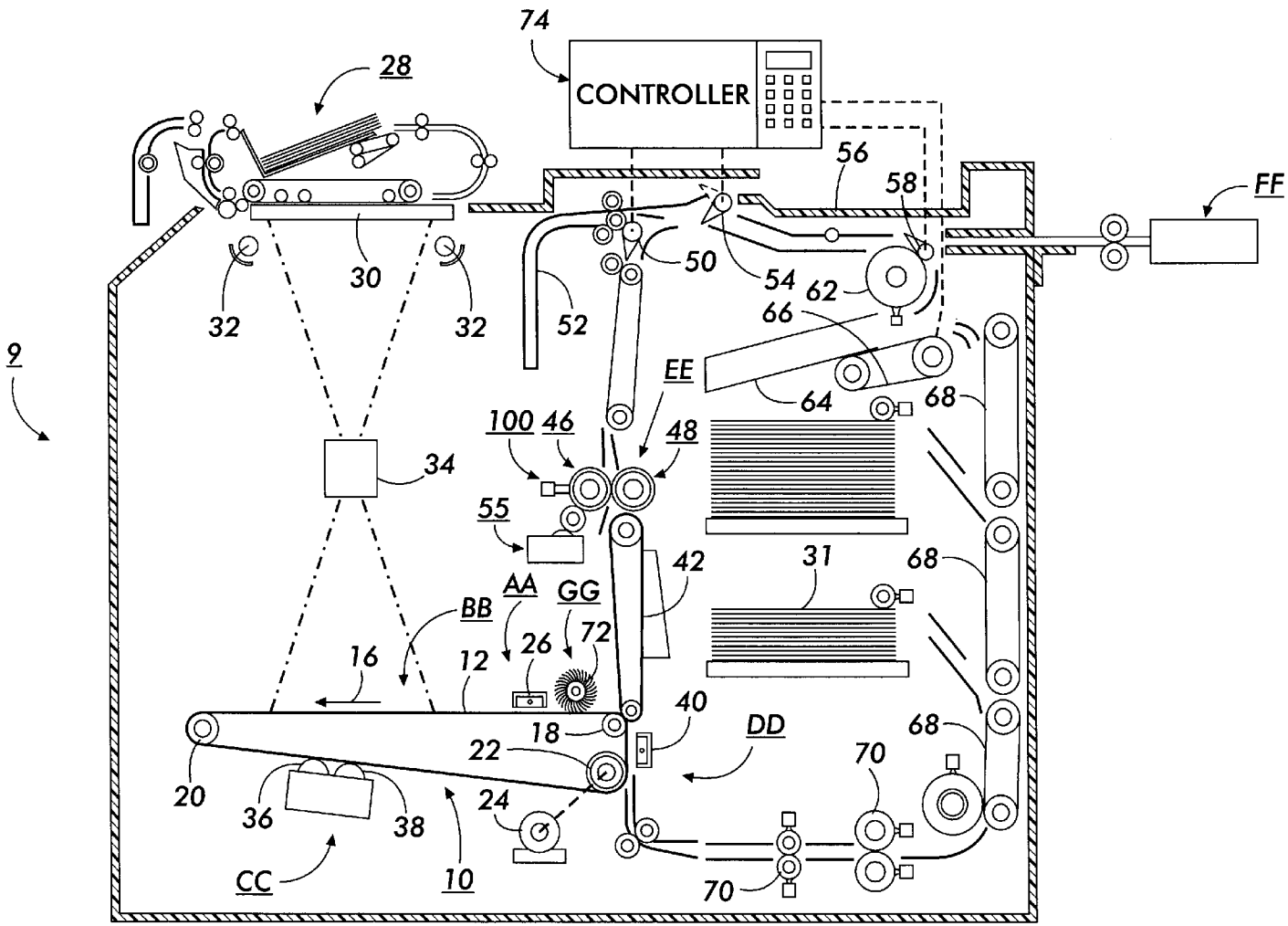
FIG. 1 is a schematic illustration of an electrostatographic reproduction machine including an induction heated fusing apparatus of the present invention.

For a general understanding of the features of the present invention, reference is made to the drawings. In the drawings, like reference numerals have been used throughout to identify identical elements. FIG. 1 schematically depicts an electrostatographic reproduction machine 9 incorporating the features of the present invention therein.

Referring to FIG. 1 of the drawings, the machine 9 employs a photoconductive member such as a belt 10 having a photoconductive surface 12 deposited on a conductive substrate (not shown). Belt 10 moves in the direction of arrow 16 to advance successive portions of photoconductive surface 12 sequentially through various electrostatographic processing stations disposed about a path of movement thereof. As shown, belt 10 is entrained about stripping roller 18, tensioning roller 20, and drive roller 22. Stripping roller 18 is mounted rotatably so as to rotate with belt 10. Tensioning roller 20 is resiliently urged against belt 10 to maintain belt 10 under the desired tension. Drive roller 22 is rotated by motor 24 coupled thereto by suitable means such as a belt drive. As roller 22 rotates, it advances belt 10 in the direction of arrow 16.

Initially, a portion of the photoconductive belt 10 passes through a charging station AA. At charging station AA, a corona generating device, indicated generally by the reference numeral 26, charges photoconductive surface 12 of belt 10 to a relatively high, and substantially uniform potential.

Next, the charged portion of photoconductive surface 12 is advanced through an imaging station BB. At imaging station BB, a document handling unit, indicated generally by the reference numeral 28, is positioned over a platen 30 of the printing machine. Document handling unit 28 sequentially feeds documents from a stack of documents placed by an operator, for example, face up in a normal forward collated order in a document stacking and holding tray. A document feeder located below the tray forwards the bottom document in the stack to a pair of take-away rollers. The belt advances the document to platen 30. After imaging, the original document is fed from platen 30 by the belt into a guide and feed roller pair. The document then advances into an inverter mechanism and back to the document stack through the feed roller pair. A position gate is provided to divert the document to the inverter or to the feed roller pair.

Imaging of a document is achieved, for example, using lamps 32 which illuminate the document on platen 30. Light rays reflected from the document are transmitted through lens 34. Lens 34 focuses light images of the original document onto a uniformly charged portion of photoconductive surface 12 of belt 10 to selectively dissipate the charge thereon. This records an electrostatic latent image on photoconductive surface 12 which corresponds to the informational area contained within the original document.

Obviously, electronic imaging of page image information could be facilitated by a printing apparatus utilizing electrical imaging signals. The printing apparatus can be a digital copier including an input device such as a Raster Input Scanner (RIS) and a printer output device such as a Raster Output Scanner (ROS), or, a printer utilizing only a printer output device such as a ROS.

Thereafter, belt 10 advances the electrostatic latent image recorded on photoconductive surface 12 to a development station CC. At development station CC, a pair of magnetic brush developer rolls indicated generally by the reference numerals 36 and 38, advance developer material into contact with the electrostatic latent image. The latent image attracts toner particles from the carrier granules of the developer material to form a toner powder image on photoconductive surface 12 of belt 10. Belt 10 then advances the toner powder image to a transfer station DD.

At transfer station DD, a copy sheet is moved into contact with the toner powder image. Transfer station DD includes a corona generating device 40 which sprays ions onto the backside of the copy sheet. This attracts the toner powder image from photoconductive surface 12. After transfer, a conveyor 42 advances the copy sheet to a fusing station EE that includes the fusing apparatus 100 of the present invention (to be described in detail below) for fixing the toner powder image to the copy sheet.

After fusing, copy sheets of the fused images are fed to gate 50 which functions, as an inverter selector. Depending upon the position of gate 50, the copy sheets are deflected to sheet inverter 52 or bypass inverter 52 and are fed directly to a second decision gate 54. At gate 54, the sheet is in a face up orientation with the image side, which has been fused, face up. If inverter path 52 is selected, the opposite is true, i.e. the last printed side is facedown. Decision gate 54 either deflects the sheet directly into an output tray 56 or deflects the sheet to decision gate 58. Decision gate 58 may divert successive copy sheets to duplex inverter roller 62, or onto a transport path to finishing station FF.

At finishing station FF, copy sheets are stacked in a compiler tray and attached to one another to form sets. The sheets are attached to one another by either a binding device or a stapling device. In either case, a plurality of sets of documents are formed in finishing station FF. When decision gate 58 diverts the sheet onto inverter roller 62, roller 62 inverts and stacks the sheets to be duplexed in duplex tray 64. Duplex tray 64 provides an intermediate or buffer storage for those sheets that have been printed on one side and on which an image will be subsequently printed on the second, opposed side thereof, i.e. the sheets being duplexed. The sheets are stacked in duplex tray facedown on top of one another in the order in which they are copied.

In order to complete duplex copying, the simplex sheets in tray 64 are fed seriatim, by bottom feeder 66 from tray 64 back to transfer station DD via conveyors 68 and rollers 70 for transfer of the toner powder image to the opposed sides of the copy sheets. Inasmuch as successive bottom sheets are fed from duplex tray 64, the proper or clean side of the copy sheet is positioned in contact with belt 10 at transfer station DD so that the toner powder image is transferred thereto. The duplex sheet is then fed through the same path as the simplex sheet to be stacked in tray 56 or, when the finishing operation is selected, to be advanced to finishing station FF.

Invariably, after the copy sheet is separated from photoconductive surface 12 of belt 10, some residual particles remain adhering thereto. These residual particles are removed from photoconductive surface 12 at cleaning station GG. Cleaning station GG includes a rotatably mounted fibrous or electrostatic brush 72 in contact with photoconductive surface 12 of belt 10. The particles are removed from photoconductive surface 12 of belt 10 by the rotation of brush 72 in contact therewith. Subsequent to cleaning, a discharge lamp (not shown) floods photoconductive surface 12 to dissipate any residual electrostatic charge remaining thereon prior to the charging thereof for the next successive imaging cycle.

The various machine functions are regulated by a controller 74. Controller 74 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. In addition, controller 74 regulates the various positions of the decision gates depending upon the mode of operation selected. Thus, when the operator selects the finishing mode, either an adhesive binding apparatus and/or a stapling apparatus will be energized and the decision gates will be oriented so as to advance either the simplex or duplex copy sheets to the compiler tray at finishing station FF.

Figure 2:
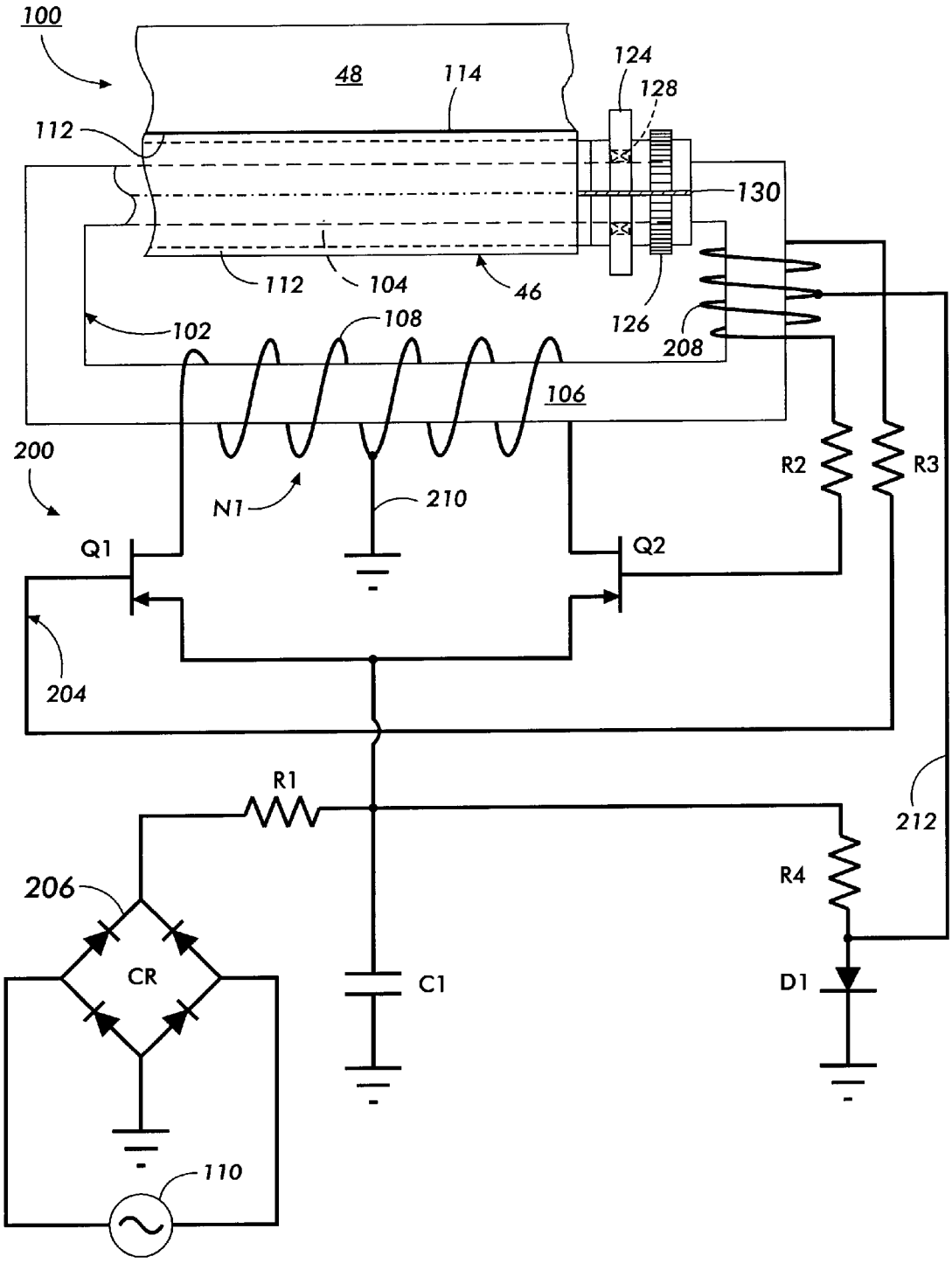
FIG. 2 is a schematic illustration of the fusing apparatus of FIG. 1 including the dual function transformer assembly in accordance with the present invention.

Referring now to FIG. 2, fusing station EE includes the fusing apparatus of the present invention, indicated generally by the reference numeral 100, which heats and permanently affixes the transferred toner powder image to the copy sheet. As further shown, fusing apparatus 100 includes an induction heated fuser roller 46 and a back-up or pressure roller 48 with the powder image on the copy sheet contacting fuser roller 46. The pressure roller 48 is cammed against the fuser roller 46 to provide necessary pressure for fixing the toner powder image to the copy sheet.

As further shown, the fusing apparatus 100 includes the pressure roller 48; a closed loop magnetic flux carrying member 102 positioned adjacent the pressure roller 48 and including a first side 104 and a second side 106 opposite the first side. The first side is located between the pressure roller 48 and the second side. The fusing apparatus 100 also includes an electrically conductive wire 108 wound about the second side 106 forming a primary transformer coil (108) having N1 number of turns. The primary transformer coil 108 is connectable to an AC power supply source 110 for inductively transferring AC electric energy to the first side 104. Importantly, the rotatable fuser roller 46 has an electrically conductive surface layer 112 forming a fusing nip 114 with the pressure roller 48. The rotatable fuser roller 46 is mounted around the first side 104 of the closed loop magnetic flux carrying member 102 and forms a secondary transformer coil (112) inductively coupled to the primary transformer coil 108 for inductively receiving AC electric energy, such that the conductive surface layer 112 thereof is inductively heated by power losses ($I^2R$) from a current induced therein when the primary transformer coil 108 is connected to the AC power supply source 110. When the primary transformer coil 108 is connected to an AC power supply source 110, a time varying magnetic flux is generated in the closed loop magnetic flux carrying member 102 by an AC current from the source 110, and operates to induce a voltage around a circumference of the fuser roller 46.

Importantly in accordance with the present invention, the fusing apparatus 100 includes a dual function transformer assembly 200 for inductively heating the induction heatable fuser roller 46 (as a first function), and for increasing, (as a second function), a supply frequency F1 of the AC power supply source 1 10 to a desired inductive heating frequency F2 for the induction heatable fuser roller 46. The dual function transformer assembly 200 includes the closed loop magnetic flux carrying member 102 comprising a transformer core having the first side 104 surrounded with the induction heatable fuser roller 46 comprising a second transformer coil. It also includes the second side 106 spaced from and opposite the first side 104. It further includes an electrical circuit subassembly 204 that is coupled to the primary transformer coil 108 and to the AC power supply source 110. In operation, the supply frequency F1 of the AC power supply source 110 is increased to the desired inductive heating frequency F2, and the heatable fuser roller 46 is inductively heated, by the transformer assembly 200.

As shown, the fuser roller 46 preferably is mounted coaxially with the first side 104 of the closed loop magnetic flux carrying member 102. Due to induction heating, the conductive surface layer 112 is maintained at a much higher temperature than any other part of the fuser roller 46. The N1 number of turns of the primary transformer coil are selected so as to yield a transformer turns ratio N1:1 that matches a given desired resistance of the conductive surface layer 112 to the characteristics of the AC power supply source 110. As further shown in FIG. 2, the fuser roller 46 includes electrically non-conductive roll end assemblies 124 including for example, a gear assembly 126, and a bearing assembly 128, for preventing current from being induced into, and undesirably heating such roll end assemblies 124. A slit 130 filled with non-conductive material is one way to achieve non-conduction by interrupting a conductive path for the induced current.

Specifically, in the fusing apparatus 100 including the dual function transformer assembly 200, the supply frequency F1 may for example comprise an AC line power frequency of 60 HZ. The desired inductive heating frequency F2 should therefore be at least 5 times greater than the supply frequency F1, and preferably ten times greater than the supply frequency F1, in order to result in a significantly reduced size and weight for the induction heatable fuser roller 46, while still delivering power equivalent to that of a larger roller heated at the supply frequency F1.

As further shown, the electrical circuit subassembly 204 includes (i) a bridge circuit 206 that is connected to the AC power supply source 110 for rectifying AC power therefrom in order to produce a DC power output; (ii) an auxiliary center tapped conductive coil winding 208 wound around the closed loop magnetic flux carrying member 102; and (iii) a pair of transistors Q1, Q2 having their respective collectors connected to opposite ends of the primary transformer coil 108 and their emitters connected to the output of bridge circuit 206. The auxiliary center tapped conductive coil winding 208 has its opposite ends connected to the base of Q1 and Q2 respectively, and its center tap to a biasing network of a resistor R4 and diode D1. In other words, the pair of transistors have their emitters connected to the output of the bridge circuit, their bases connected to opposite ends of the auxiliary conductive coil winding, and their collectors to opposite ends of the primary transformer coil. As shown, each half of the primary transformer coil 108 is powered in turn as switching transistors Q1 and Q2 are alternately driven into conduction by the voltage swings across the auxiliary conductive coil 208.

In the fusing apparatus 100, $I^2R$ heating (power dissipation) current in the induction heated fuser roller 46 is generated by flux changes in one leg 106, of the transformer core 102, encircled by roller 46. The voltage (and current) induced into the conductive layer or sleeve 112 of the roller 46 has been found to be directly proportional to the transformer's cross-sectional area, and to the magnetic field's frequency. Thus, a 60 Hz line power frequency, (F1), can be rectified and converted to a 600 Hz magnetic field frequency, (F2), using the pair of switching transistors Q1, Q2, in combination with the induction roller's transformer assembly. This advantageously eliminates the need for a separate frequency inverter power supply, and enables the use of significantly smaller and economical fuser rollers.

In an induction heated roller arrangement, the amount of heat transferred to the conductive layer or sleeve 112 per inch of roller length has been found to be directly proportional to the square of the power or supply source frequency F1, and to the square of the cross-section of side 104 of transformer core 102, which is enclosed by the roller 46. Therefore in order for the transformer's core to fit through a small diameter heated fuser roller, the cross-section of the transformer's core must itself be correspondingly small. In order to deliver the same heating power as a bigger core, such a correspondingly small core must therefore be operated at a substantially higher frequency, F2. For example, a transformer can deliver the same power at 600 Hz frequency with a core having 1/10th the cross-sectional area of a core operated at a 60 Hz frequency.

However, if the roller induction heating transformer core 102 is to be operated at 600 Hz (F2), then the frequency of the primary power source, F1 must first be converted from 60 Hz, to the 600 Hz AC. One way to do this is by using rectified line power to drive a separate DC/AC inverter, and then using the output of this inverter to power the roller induction heating transformer. However, the separate inverter power supply will degrade the overall power efficiency of the fuser, require additional space, and add weight and cost to the system, Therefore, in accordance with the present invention, the primary winding 108 of the dual function transformer assembly 200 is connected directly to the 60 Hz power source. FIG. 2 clearly illustrates how an induction heated roll transformer can serve as the transformer for both the induction heated roll 46, and as the DC to the 600 Hz AC inverter.

In the circuit in FIG. 2, 60 Hz line power 110, is rectified by the bridge circuit 206, and smoothed by low pass filter elements R1 and C1 to produce DC power. The output voltage of this DC power supply is then fed alternately to opposite ends of transformer primary winding 108 by a pair of switching transistors Q1 and Q2. The power supply current return path is via a tap 210 connected to the center of the primary winding 108. Transistors Q1 and Q2 are turned on and off alternately by connecting their bases to the opposite ends of winding 208 through resistors R2 and R3 as shown. The bias voltage for the emitter base junctions of Q1 and Q2 is applied through the center tap 212 of auxiliary winding 208. The emitter base bias is clamped by diode D1 during portions of the conduction cycles of Q1 and Q2 in order to limit their base currents to a safe value. The turns ratio for auxiliary winding 208 is determined by the transistor's base current and base emitter saturation voltage specifications, and as well by the forward conduction voltage of the diode D1 and the value of resistor R4.

The type of self-excited single converter embodied in the transformer assembly 200 of the present invention is similar to what is known, per se, as the Royer Oscillator, and is, for example, discussed in textbooks dealing with power supplies. For background understanding, a Royer Oscillator oscillates at a frequency given by:

$$\text{Frequency (Hz)}=(V_s\times10^{-8})/(4\times N_p\times B_m\times A_c)$$

where $V_s$=source voltage applied at the primary center tap $N_p$=# of turns from primary center tap to one end $B_m$=saturation flux density of the core in gauss $A_c$=cross-sectional area of the core in $cm^2$ Although an inductive heating frequency F2 of 600 Hz has been used in the discussion here as an example, it should be clear that any frequency up through the audio range can be used to power the induction heated roller 46, for the purpose of reducing the size and weight of the transformer core and of the roller.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. An induction heated fusing apparatus having a dual function transformer assembly, the induction heated fusing apparatus comprising:

(a) a pressure roller;

(b) an induction heatable fuser roller having an electrically conductive layer, said heatable fuser roller forming a fusing nip with said pressure roller; and (c) a dual function transformer assembly for inductively heating said induction heatable fuser roller as a first function, and for increasing a supply frequency F1 of an AC power supply source to a desired inductive heating frequency F2 for said induction heatable fuser roller as a second function, said dual function transformer assembly including:

(i) a closed loop magnetically permeable member comprising a transformer core having a first side surrounded with said induction heatable fuser roller as a secondary transformer coil, and a second side including a primary transformer coil winding thereover;

(ii) an electrical circuit subassembly coupled to said primary transformer coil and connectable to the AC power supply source having said supply frequency F1, whereby said supply frequency F1 is increased to said desired inductive heating frequency F2, and said heatable fuser roller is inductively heated by said transformer assembly when said electrical circuit subassembly is connected to the AC power supply source, said electrical circuit subassembly including (i) a bridge circuit connectable to the AC power supply source for rectifying AC power therefrom to produce a DC power output, (ii) an auxiliary conductive coil winding around said closed loop magnetic flux carrying member; and (iii) a pair of transistors having their emitters connected to the output of said bridge circuit, their bases connected to opposite ends of said auxiliary conductive coil winding, and their collectors to opposite ends of said primary transformer coil, wherein said pair of transistors and said primary transformer coil are alternately driven by voltage changes across said auxiliary conductive coil winding.

2. The fusing apparatus of claim 1, wherein said supply frequency F1 comprises an AC line power frequency of 60 HZ.

3. The fusing apparatus of claim 1, wherein said desired inductive heating frequency F2 is at least 5 times greater than said supply frequency F1 in order to reduce a size and weight of said induction heatable fuser roller while delivering power equivalent to that of a larger roller heated at said supply frequency F1.

4. The fusing apparatus of claim 3, wherein said desired inductive heating frequency F2 is at least ten times greater than said supply frequency F1.

* * * * *